United States Patent [19]

Rockerath et al.

[11] 4,095,538

[45] Jun. 20, 1978

[54] MATERIAL FOLDING DEVICE

[75] Inventors: John L. Rockerath; Harold J. Schreck, both of Utica, N.Y.

[73] Assignee: Jetsew, Inc., Barneveld, N.Y.

[21] Appl. No.: 651,449

[22] Filed: Jan. 22, 1976

[51] Int. Cl.[2] ..... D05B 35/04

[52] U.S. Cl. ..... 112/147; 112/141

[58] Field of Search ..... 112/147, 141, 142, 143, 112/153, 121.11, 121.12, 121.15, 203, DIG. 2; 270/93

[56] References Cited

U.S. PATENT DOCUMENTS

| | | | |
|---|---|---|---|
| 3,277,851 | 10/1966 | Dobner et al. | 112/147 |
| 3,400,674 | 9/1968 | McClintock | 112/121.15 |
| 3,463,482 | 8/1969 | Baron et al. | 112/147 X |
| 3,534,954 | 10/1970 | Lynch, Jr. | 112/147 X |
| 3,618,546 | 11/1971 | Preston | 112/121.29 |
| 3,776,156 | 12/1973 | Morgan | 112/141 |
| 3,898,941 | 8/1975 | Crawford et al. | 112/147 X |
| 4,009,672 | 3/1977 | Rockerath et al. | 112/141 X |

*Primary Examiner*—Werner H. Schroeder
*Assistant Examiner*—Peter Nerbun
*Attorney, Agent, or Firm*—Prutzman, Hayes, Kalb & Chilton

[57] ABSTRACT

A sewing machine installation with a material folding device for automatically prefolding a curtain rod box hem along an edge of a curtain as the curtain is conveyed forwardly through the material folding device to a stitching station.

14 Claims, 12 Drawing Figures

MATERIAL FOLDING DEVICE

BRIEF SUMMARY OF THE INVENTION

The present invention relates generally to material folding devices for automatically prefolding a hem or the like along an edge of a material blank as it is conveyed forwardly through the material folding device to a stitching station of a sewing machine and more particularly to a new and improved material folding device having notable utility in folding a curtain rod box hem along the edge of a curtain.

It is a principal aim of the present invention to provide a new and improved hem folding device useful in a sewing machine installation for automatically prefolding a curtain rod box hem along an edge of a curtain as the curtain is conveyed forwardly through the folding device to a stitching station of the sewing machine installation.

It is another aim of the present invention to provide a new and improved hem folding device for automatically folding a relatively wide hem of, for example, 3 to 5 inches along the edge of a material blank.

It is a further aim of the present invention to provide a new and improved material folding device for automatically folding an improved hem along the edge of a material blank by a single pass of the material blank through the material folding device.

It is another aim of the present invention to provide a new and improved hem folding device of the type described useful in a sewing machine installation for prefolding a hem along an edge of each of a plurality of material blanks as they are conveyed in succession at a relatively high rate of speed through the folding device to a stitching station of the sewing machine installation.

It is another aim of the present invention to provide a new and improved material folding device of the type described which is useful with either double-knit or other stretch fabrics or with tightly woven fabrics.

It is a further aim of the present invention to provide a new and improved hem folding device of the type described which is useful in folding a first edge portion of a material blank which is presewn and/or prefolded along a second edge portion extending generally normal to and across the first edge portion and thereby making the first edge portion more rigid and difficult to correctly fold.

It is another aim of the present invention to provide a new and improved hem folding device of the type described providing reliable operation over a long service-free useful life.

Other objects will be in part obvious and in part pointed out more in detail hereinafter.

A better understanding of the invention will be obtained from the following detailed description and the accompanying drawings of illustrative applications of the invention.

DESCRIPTION OF THE PREFERRED EMBODIMENTS

Figure 1:
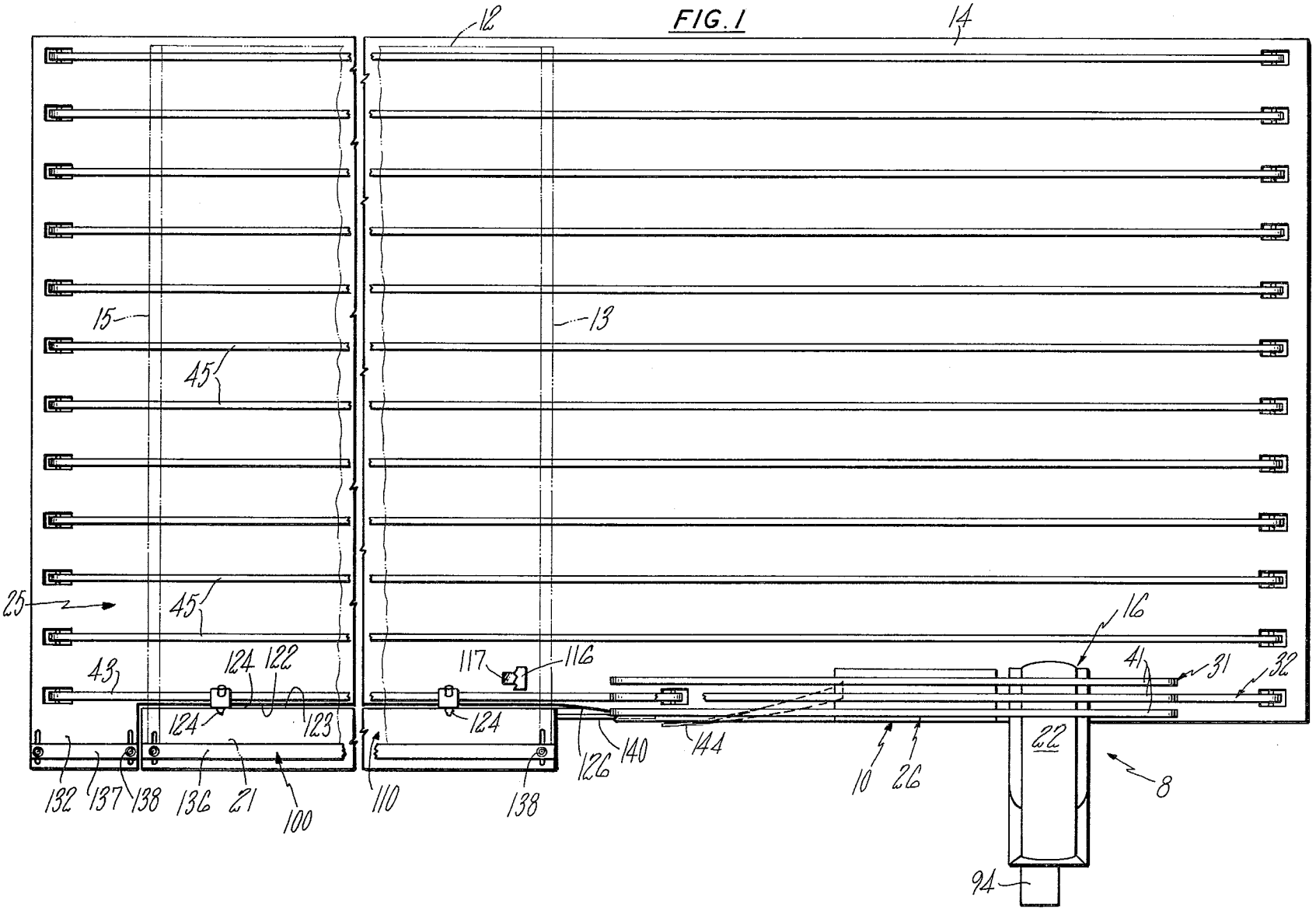
FIG. 1 is a top plan view, partly broken away, of a sewing machine installation incorporating an embodiment of a material folding device of the present invention.
Figure 2:
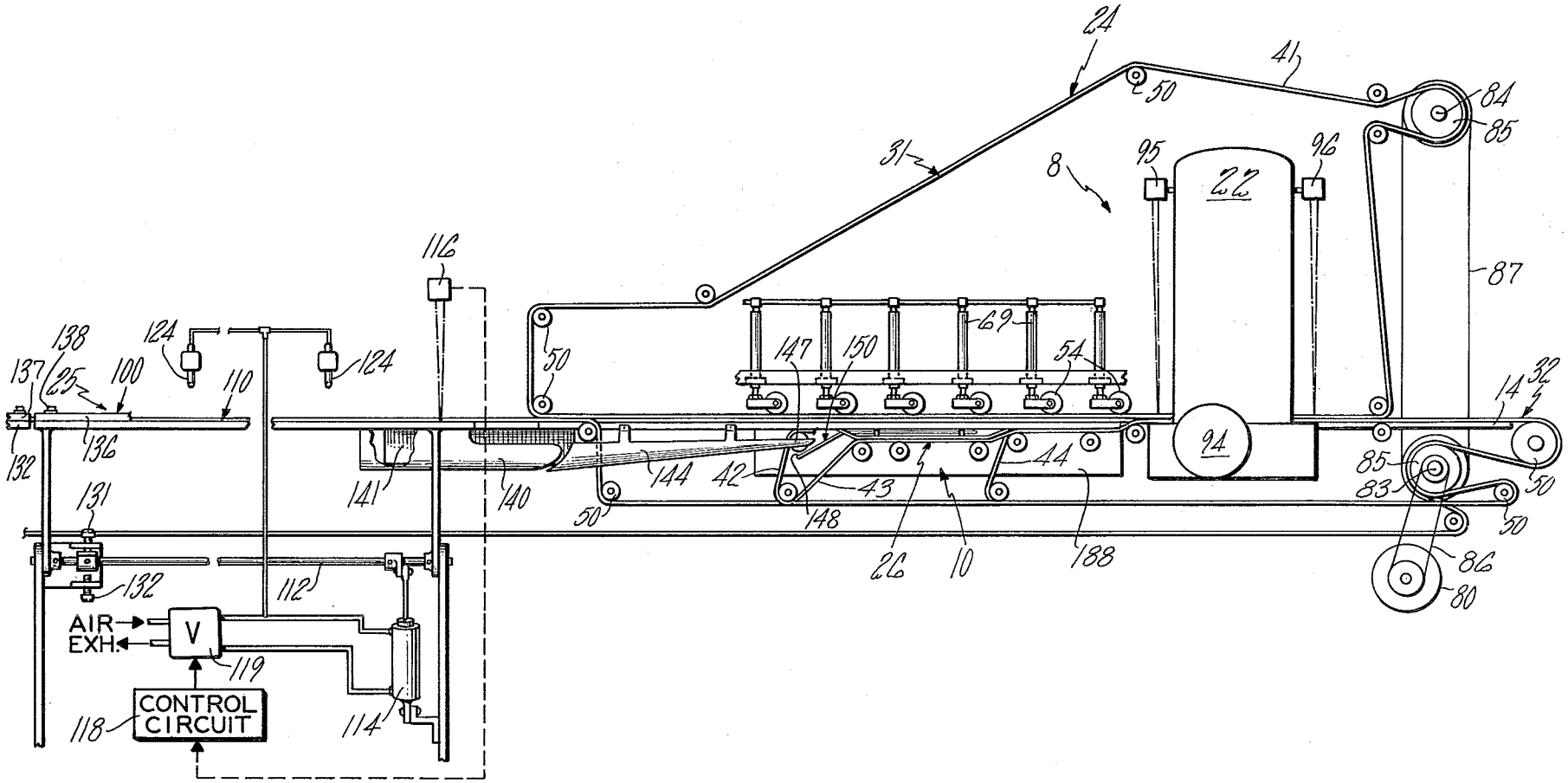
FIG. 2 is an enlarged partial longitudinal elevation view, partly broken away, of the sewing machine installation taken from the back thereof.

Referring now to the drawings in detail wherein like numerals represent like parts throughout the several figures, and referring in particular to FIGS. 1–8, a sewing machine installation 8 incorporates an embodiment 10 of a material folding device of the present invention which provides for automatically folding an edge portion 21 of a precut material blank or curtain 12 into a curtain rod box hem 11 as the material blank 12 is fed longitudinally forwardly, from left to right as viewed in FIG. 1 and from left to right as viewed in FIG. 2, along a material support table 14 through the material folding device 10 to a sewing or stitching station 16.

As shown in FIG. 1, the curtain 12 may be prehemmed and presewn along its leading edge 13 and trailing edge 15 which extend normal to and across the edge portion 21. The curtain rod box 11 as prefolded by the material folding device 10 is stitched at the stitching station 16 by two lines of stitching 19 along the inner and outer edges of the hem 11 by a pair of transversely spaced stitching needles 18 of a sewing machine head 22. (Alternatively, if desired, a single line of stitching 19 along the inner edge of the hem 11 may be applied in lieu of the two lines of stitching.) The laterally spaced lines of stitching 19 provide a curtain rod mounting pocket 23 therebetween for receiving a curtain rod in a conventional manner (and alternatively, a single line of stitching 19 along the inner edge of the hem could be used to provide a curtain rod mounting pocket between the inner line of stitching 19 and the outer folded edge of the hem 11).

The sewing machine installation 8 employs a belt conveyor system 24 for conveying the material blanks 12 in succession longitudinally forwardly, first along an entry end 25 of the support table 14, then through a material edge folder 26 of the material folding device 10 and then through the stitching station 16. The belt conveyor system 24 comprises upper and lower belt conveyors 31, 32 respectively with three laterally spaced pairs 38, 39, 40 of overlying conveyor belts 41 and underlying conveyor belts 42, 43, 44 engageable along a plane slightly above the support table 14 for assisting in individually longitudinally forwardly advancing the material blanks 12 along the table 14. Referring to FIG. 2, the three overlying laterally spaced conveyor belts 41 follow generally the same circuitous path, whereas the three underlying conveyor belts 42–44 follow different circuitous paths. In that regard, the middle underlying conveyor belt 43 is fed forwardly along the table 14 from the entry end 25 of the table 14 to a point rearward of the edge folder 26 and whereby the middle underlying conveyor belt 43 assists in forwardly feeding each material blank 12 along the table to the edge folder 26. The lower belt conveyor 32 also comprises eleven additional laterally spaced conveyor belts 45 (FIG. 1) which provide for conveying the body of the curtain 12 along the table 14.

Figure 7:
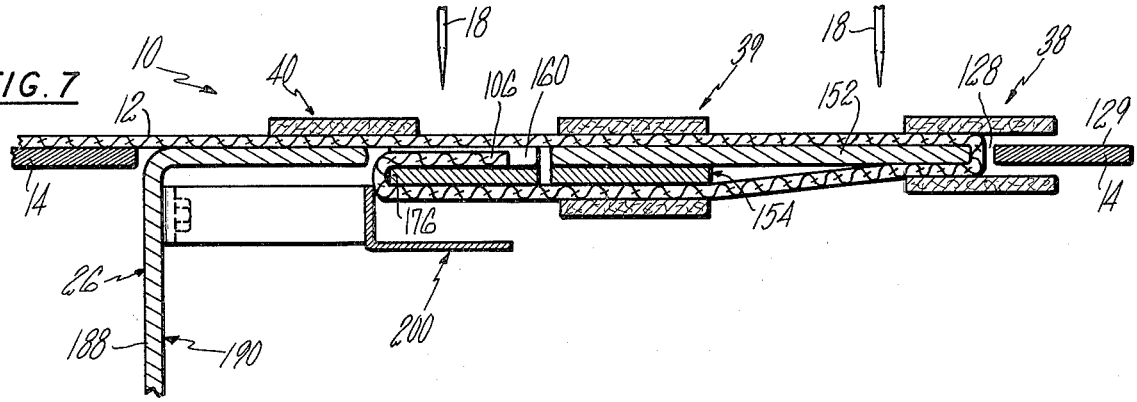
Figure 8:
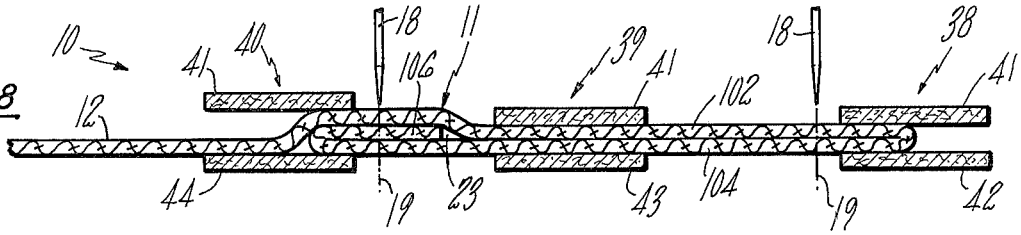
FIG. 8 is an enlarged partial transverse elevation section view, partly broken away and partly in section, showing a folded edge portion of a material blank at a stitching station of the sewing machine installation.

Referring to FIGS. 7 and 8, the three pairs 38–40 of cooperating conveyor belts are respectively positioned centrally between and immediately laterally outwardly and inwardly of the two laterally spaced sewing machine needles 18 and such that the three pairs 38–40 of conveyor belts do not interfere with the stitching operation of the sewing machine head 22 at the stitching station 16. A forward portion of the belt conveyor system 24 forward of the stitching station 16 provides for assisting in conveying the material through the stitching station 16 and forwardly off the exit end of the table 14 for stacking the sewn curtains in a suitable hopper (not shown).

The conveyor belts 41–45 are supported on suitable guide rollers 50 mounted for rotation about parallel laterally extending axes for guiding the endless conveyor belts 41–45 around their circuitous paths. The upper conveyor 31 has a belt conveyor section with a plurality of pneumatically operated pressure rolls 54 that engage the three overlying conveyor belts 41 for assisting in feeding the material blank 12 along the table 14 and through the material edge folder 26. The pressure rolls 54 are mounted on piston rods of suitable air cylinders 69 respectively. The air cylinders 69 are of the type having internal compression springs (not shown) for retracting the pressure rolls 54 upwardly from the conveyor belts 41 and are suitably connected in parallel to an air source (not shown) and through a suitable adjustable pressure regulator (not shown) to adjust the pressure roll force on the conveyor belts 41.

The upper and lower conveyor belts 41–45 are driven together by a motor 80, continuously during the normal operation of the sewing machine installation 8, via parallel drive shafts 83, 84 and knurled drive rolls or wheels 85 fixed onto the shafts 83, 84. The shafts 83, 84 are connected to the motor 80 via drive or timing belts 86, 87 and suitable pulleys to be driven at the same angular velocity. The knurled drive wheels 85 mounted on shafts 83, 84 provide for driving all of the conveyor belts 41–45 together and preferably at substantially the same linear speed. The conveyor belts 41–45 are elastic and are mounted in a slightly stretched condition to firmly engage the knurled drive wheels 85 and avoid belt slippage.

The sewing machine head 22 is connected to be driven by a separate motor 94 and so that the sewing machine head is driven at a speed coordinated with the linear speed of the belt conveyors 31, 32. The sewing machine motor 94 is automatically timely energized by suitable photoelectric sensors 95, 96 which sense the leading and trailing edges respectively of the material blank 12 to completely sew the curtain rod box hem 11 along its entire length as the prefolded material blank 12 passes through the stitching station 16.

To form a completed curtain, a precut and if desired prehemmed curtain material blank 12 is manually fed longitudinally forwardly onto the rear or entry end 25 of the table 14 with its lateral edge portion 21 in generally abutting engagement with a locating edge or guide 100 of the table 14. The curtain blank 12 is then conveyed longitudinally forwardly along the table 14 by the continuously running belt conveyor system 24 through the material edge folder 26 and stitching station 16 and off the forward or exit end of the table 14.

Referring to FIG. 8, the curtain rod box hem 11 formed with the material folding device 10 has an overlying or front hem face 102, and underlying or back hem face 104, and an outwardly folded or tucked edge portion 106 at the inner edge of the back hem face 104 and between the front and back hem faces 102, 104. The curtain rod box hem 11 is therefore formed to have a clean outer and inner appearance with the tucked edge portion 106 hidden and being secured in place by the inner line of stitching 19.

An elongated retractable table edge section 110 of the material folding device 10 is provided along the outer longitudinally extending edge of the entry end 25 of the table 14 and just forwardly of the rear edge of the table. The retractable table edge section 110 has a length greater than the length of the outer edge portion 21 of the material blank 12 and is timely momentarily retracted when it fully supports the outer material edge portion 21 of each material blank 12 as the blanks are longitudinally conveyed in succession along the table. Referring particularly to FIG. 2, the table edge section 110 is pivotally mounted by means of a longitudinally extending rotatably mounted rod 112 and is connected to be pivotally retracted from and returned to its normal extended position shown in FIGS. 1 and 2 by a dual acting air cylinder 114. A suitable photoelectric sensor 116 of the type having an internal light source and a suitable light sensitive pickup is mounted to cooperate with a piece of reflective tape 117 (FIG. 1) located on the table adjacent the forward end of the table edge section 110. The sensor 116 is connected to a suitable control circuit 118 for operating an air valve 119 for the air cylinder 114 for momentarily retracting the table edge section 110 when the outer edge portion 21 of each material 12 is conveyed over the reflective tape 117. The entire outer edge portion 21 of the material blank 12 is thereby released to drop downwardly about a fixed longitudinally extending fold edge 122 of the table 14. An initial 90° downward fold of the material edge portion 21 is thereby made in advance of the edge folder 26 and parallel to the outer edge of the material and direction of movement of the material blank across the table 14. Also, a pair of air nozzles 124 located above the fold edge 122 are suitably connected to an air pressure source, as by the valve 119 operated by the photoelectric sensor 116, to blow the material edge portion 21 downwardly and thereby assist in folding it about the fold edge 122. After a very short but sufficient interval to permit the material edge portion 21 to be folded downwardly about the fold edge 122, the control circuit 118 automatically returns the table edge section 110 to its normal position with its upper face coplanar with the rest of the horizontal table 14 and with its inner longitudinally extending edge 123 slightly outward of the fold edge 122 to form an intermediate slot 124 permitting the depending material edge portion 21 to pass freely therebetween. A pair of adjustable threaded stops 131, 132 (FIG. 2) are provided for establishing the normal and retracted positions of the table edge section 110.

The longitudinally extending fold edge 122 of the table 14 is parallel to the path of movement of the material 12 along the slot 124 and extends forwardly therefrom to form an outwardly tapered fold edge section 126 rearwardly of the edge folder 26 to tighten the material fold about the fold edge as the material is conveyed forwardly from slot 124 to the material edge folder 26. In addition, the outer edge 127 of the edge folder 26 is forwardly outwardly tapered slightly. The tapered fold edge 127 provides for maintaining the material fold taut as the material blank 12 is conveyed forwardly through the folder 26 and so as to produce an accurately dimensioned hem 11 with flat and smooth material faces 102, 104. Also, an outer table strip 129 (FIGS. 3 and 7) is provided slightly outwardly of the fold edge 127 to establish an intermediate material guide slot 128 for guiding the outer material fold through the edge folder 26. The table strip 129 also provides for partly supporting the outer pair 38 of overlying and underlying conveyor belts 41, 42 which are generally centered over the material guide slot 128.

The retractable table edge section 110 and a fixed rear edge section 132 of the table have aligned edge guide segments 136, 137 respectively forming the edge guide 100 along which the edge of the material blank is initially conveyed for laterally positioning the material blank 12. The edge guide segments 136, 137 are mounted with suitable fasteners 138 to be laterally adjusted for establishing the desired width of the material edge portion 21 folded about the fold edge 122 and for thereby establishing the resulting width of material forming the underlying hem face 104 and inturned edge 106 of the curtain rod box hem 11.

A pair of depending sheet metal guides 140, 141 are mounted in alignment with the retractable edge 123 and fixed fold edge 122 respectively to guide the depending material edge portion 21 along a generally vertical path to a succeeding intermediate fixed sheet metal guide 144 contoured to gradually fold the edge portion 21 laterally inwardly and upwardly to a generally horizontal plane underlying the horizontal plane of the table 14. The outer retractable sheet metal guide 140 is formed to curve slightly inwardly and upwardly to ensure that the leading edge of the depending material edge portion 21 is guided inside the intermediate sheet metal guide 144. Also, the intermediate sheet metal guide 144 has a forward or exit end 147 above the entry end 148 of a sheet metal guide 150 of the folder 26 so that material edge portion 21 is guided above the edge folder guide 150.

Figure 4:
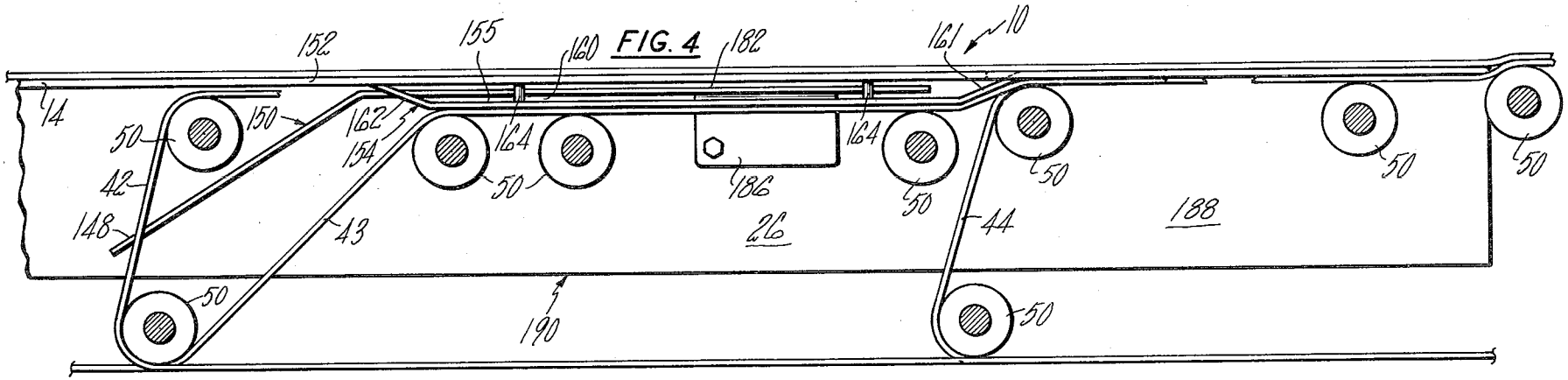
Figure 5:
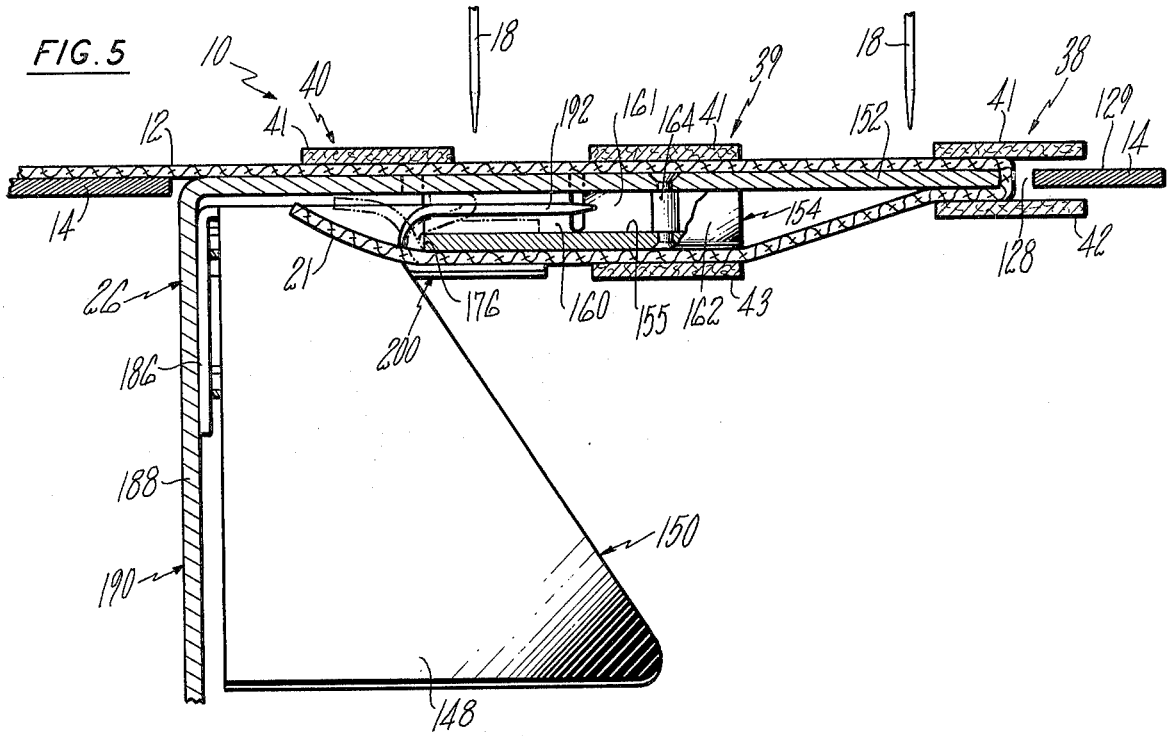
FIGS. 5, 6 and 7 are enlarged partial transverse elevation section views of the sewing machine installation taken substantially along lines 5—5, 6—6 and 7—7 of FIG. 3 respectively, and additionally showing transverse sections of an edge portion of a material blank as it is conveyed through the material edge folder.
Figure 6:
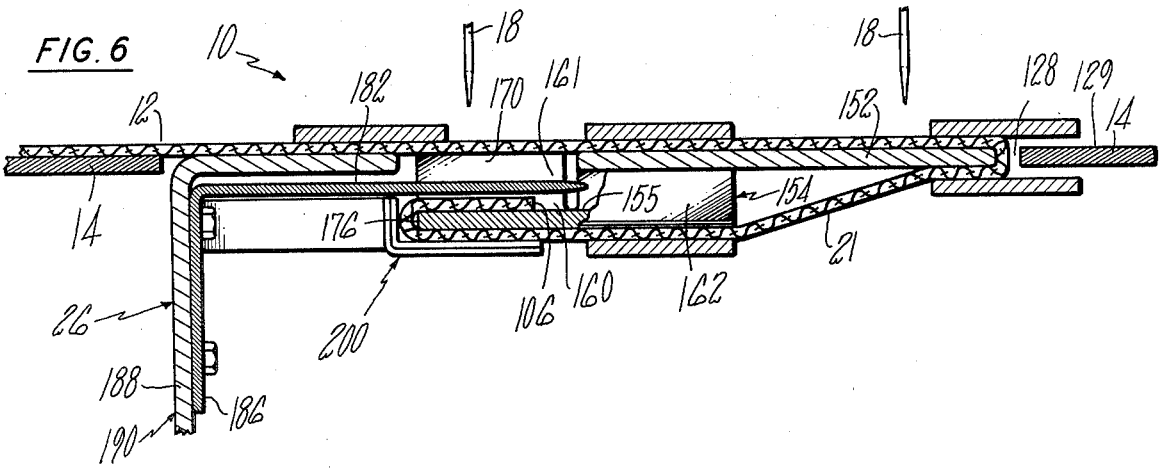

Referring to FIG. 4, the outer underlying conveyor belt 42 initially engages the material edge portion 21 of the material blank 12 at the rear or entry end of the folder 26 and after the material edge portion 21 has been folded upwardly to underlie the table. From that point forward, the outer underlying conveyor belt 42 assists the three overlying conveyor belts 41 in conveying the material blank 12 forwardly through the folder 26 and then through the stitching station 16. Referring to FIGS. 5–7, the outer underlying conveyor belt 42 biases the material edge portion 21 against the flat underside of a flat upper face plate 152 of the folder 26 as the material is conveyed through the folder. Also, the outer underlying conveyor belt 42 along with the other two underlying conveyor belts 43, 44 convey the folded material edge portion 21 upwardly from the underside of the edge folder 26 onto the table 14 and into engagement with the overlying conveyor belts and then, in cooperation with the overlying conveyor belts, convey the prefolded hem 11 through the stitching station 16.

An elongated sheet metal shelf member 154 is mounted beneath the folder face plate 152 to provide a central horizontal shelf 155 parallel to and spaced below the face plate 152 and so as to provide a longitudinally extending pocket 160 therebetween. The shelf member 154 has upturned longitudinally spaced front and rear end ramps 161, 162 and an elongated cantilever exit guide 170 extending forwardly from the front ramp 161 within an elongated slot 172 in the face plate 152. The center underlying conveyor belt 43 is directed by its supporting rolls to bias the material edge portion 21 against (and thereby convey the material along) the underside of the shelf 155, front end ramp 161 and face plate 152 to the forward edge of the edge folder 26. The center underlying conveyor belt 43 is then directed upwardly onto the table 14 like the outer and inner underlying conveyor belts 42, 44 to assist in conveying the folded material edge portion 21 into engagement with the overlying conveyor belts 41 and then through the stitching station 16.

The shelf member 154 is attached to the underside of the folder face plate 152 by a pair of rivet type fasteners 164 (FIGS. 3 and 4) mounted along the outer edge of the shelf member 154 and whereby the inner portion of the pocket 160 remains unblocked. The inner straight longitudinally extending edge 176 of the shelf member 154 is parallel to the longitudinal path of movement of the material blank 12 and, as will be described more fully hereinafter, provides an inner lower fold edge for folding the tucked edge 106 upwardly and inwardly between the front and back hem faces 102, 104.

Figure 3:
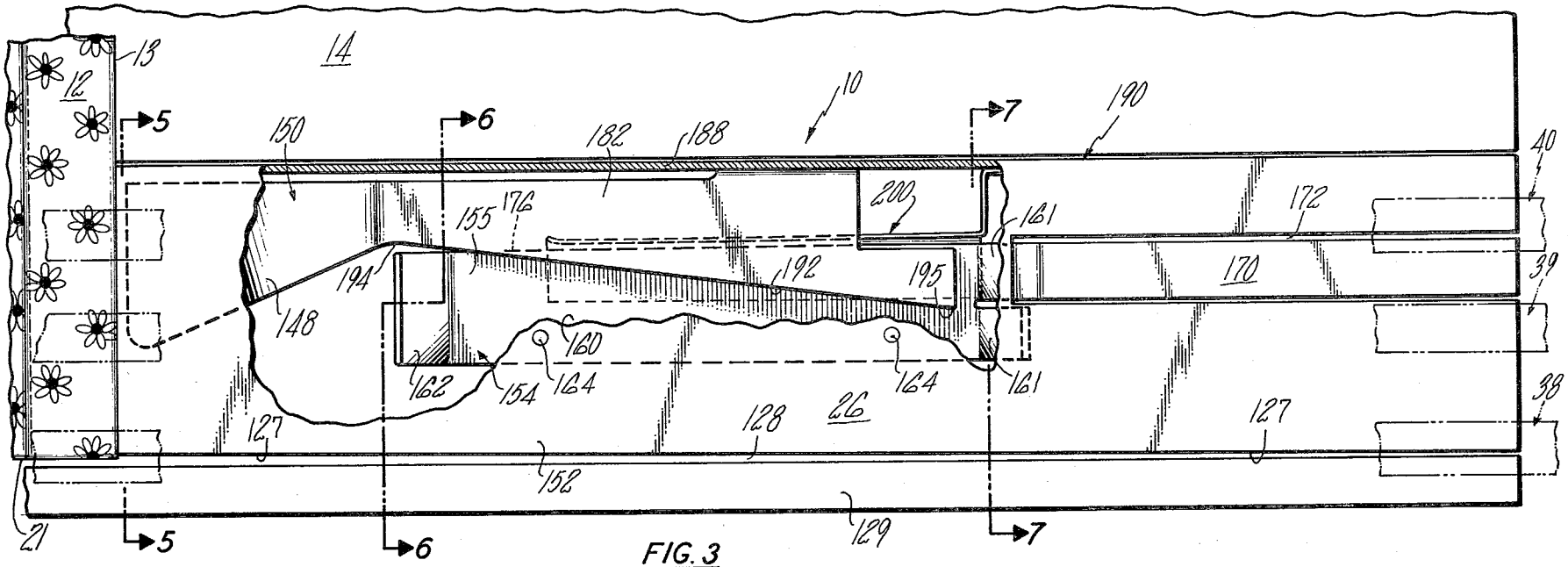
FIGS. 3 and 4 are respectively an enlarged partial top plan view and a longitudinal elevation section view, each partly broken away and partly in section, of the sewing machine installation, showing a material edge folder of the material folding device.

Referring to FIGS. 3 and 7, the inner underlying conveyor belt 44 underlies the edge 176 of the shelf and is directed by its supporting rolls to bias the material edge portion 21 against the inner edge of the cantilever exit guide 170 and whereby the back hem face 104 is engaged and conveyed forwardly by the outer underlying conveyor belt 44 along with the underlying conveyor belts 42, 43.

The rear end 148 of the sheet metal guide 150 is inclined upwardly for guiding the underlying material edge portion 21 upwardly about the shelf fold edge 176. The sheet metal guide 150 has a forward flat material fold portion 182 mounted in parallel spaced relationship to and between the shelf 155 and the folder face plate 152. A depending tab 186 of the sheet metal guide 150 provides for mounting the guide to a depending support plate 188 of an L-shaped channel 190 providing the folder face plate 152.

The flat horizontal material fold portion 182 of the guide 150 has an outer straight longitudinally extending edge 192 inclined forwardly laterally outwardly from a rear terminus 194 rearwardly and inwardly of the pocket 160 to a forward terminus 195 within the pocket 160. The inclined outer edge 192 of the guide 150 thereby acts to gradually fold the material edge 106 inwardly into the pocket 160 and about the inner straight fold edge 176 of the shelf member 154 as shown in broken lines in FIG. 5 The forward end of the inclined guide edge 192 preferably extends laterally outwardly into the pocket 160 greater than the width of the inturned edge 106 to assure that the edge 106 is completely folded into the pocket 160 as seen in FIG. 6 before it reaches the exit guide 170. Accordingly, the inturned or tucked edge 106 and back hem face 104 emerge from the forward end of the folder 26 with the tucked edge 106 in engagement with and between the front and back hem faces 102, 104 for being sewn together at the sewing station as described. Referring to FIGS. 3, 6 and 7, an L-shaped guide 200, shown mounted on the support plate 188, may be provided to hold the inner material fold in engagement with the fold edge 176 and to assist in guiding the material fold along the exit guide 170 and into and through the slot 172 of the face plate 152. Also, the inner underlying conveyor belt 44 is directed to engage the outer edge of the back face 104 of the hem 11 to assist in feeding the back face 104 and inwardly tucked edge 106 upwardly onto the table 14.

Figure 12:
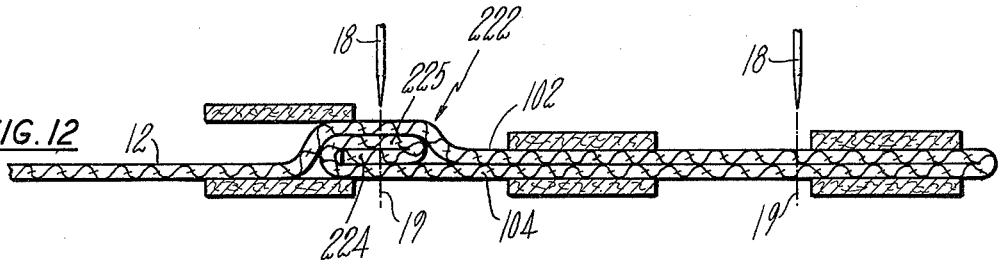
FIG. 12 is an enlarged partial transverse elevation section view, partly broken away and partly in section, similar to FIG. 8 and showing a modified folded edge portion of a material blank provided by the modified edge folder of FIGS. 9–11.
Figure 11:
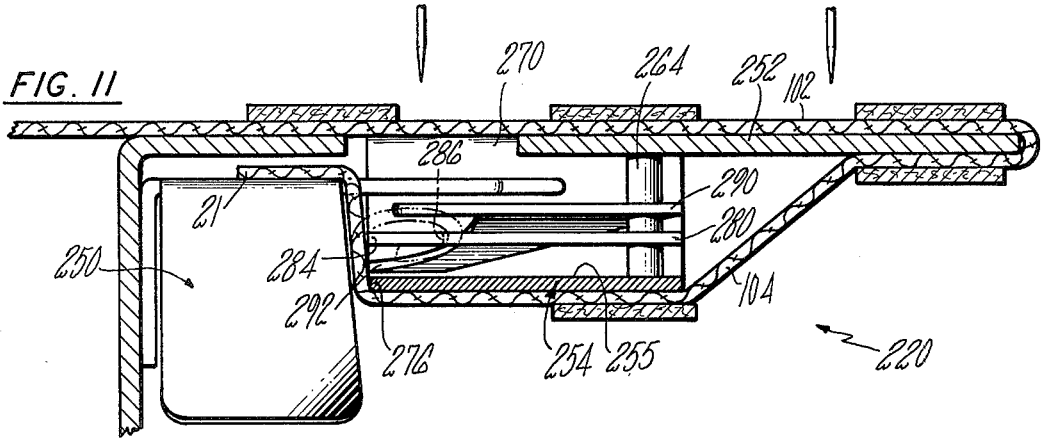
FIG. 11 is an enlarged transverse elevation section view of the modified material edge folder, taken substantially along line 11—11 of FIG. 9, and additionally showing transverse sections of an edge portion of a material blank as it is conveyed through the modified material edge folder.
Figure 9:
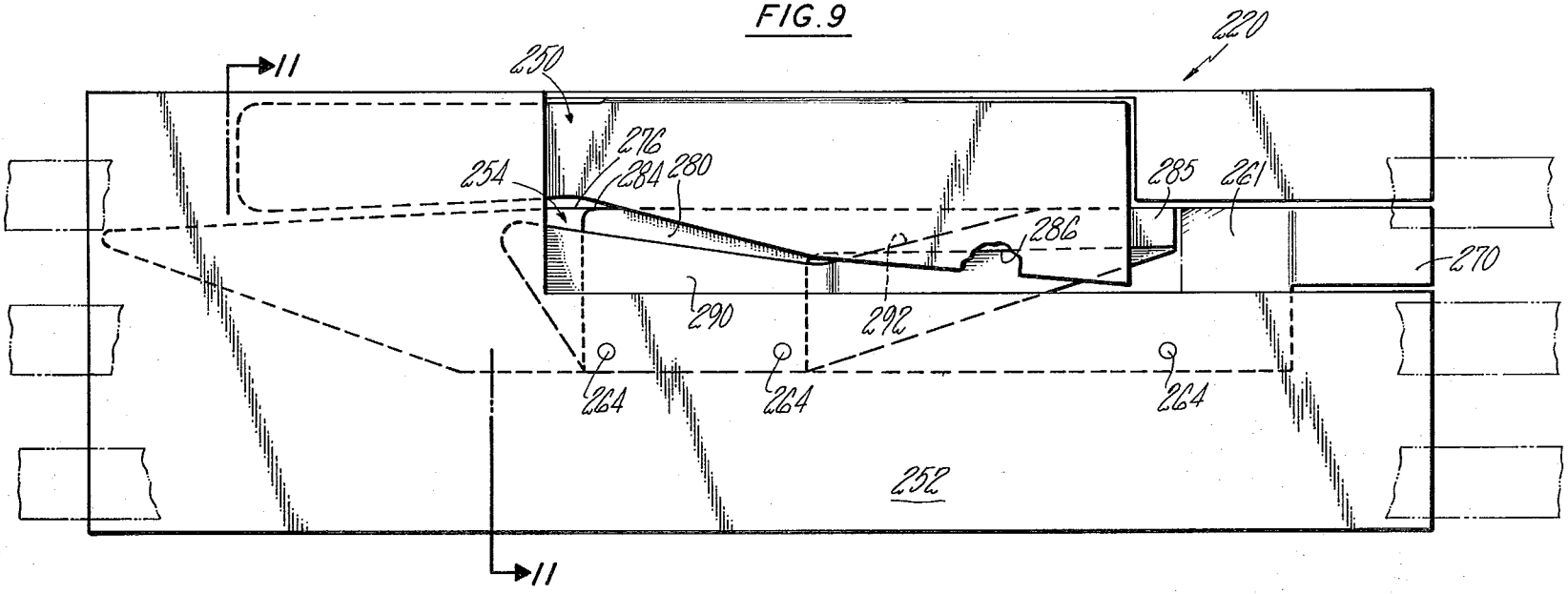
FIGS. 9 and 10 are respectively an enlarged partial top plan view and a longitudinal elevation view, each partly broken away, of a modified material edge folder.
Figure 10:
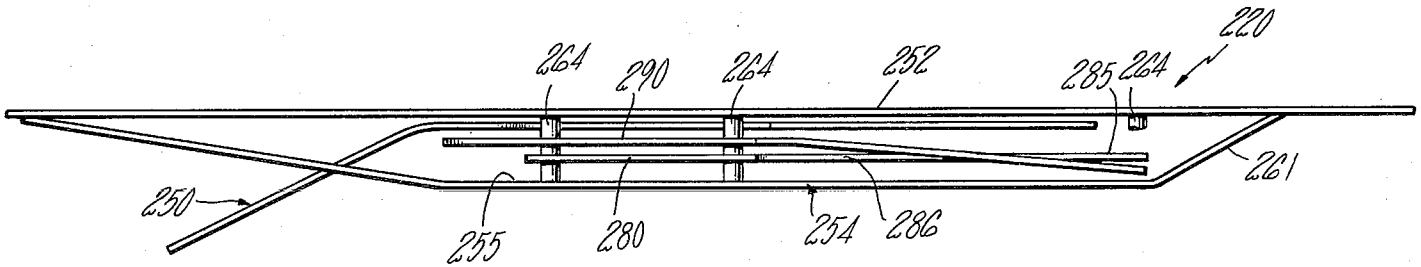

Referring to FIGS. 9–11, there is shown a modified edge folder 220 useful for folding a modified form of hem 222 shown in transverse section in FIG. 12 and which, in addition to the form of hem shown in FIG. 8, has a secondary tucked edge 224 tucked between a first tucked edge portion 225 and the back face 104 of the hem. Such a modified hem form 222 is useful for example with relatively shear curtain material and, where using a hem form 11 as shown in FIG. 8, the usual irregular material edge may be seen through the front hem face 102 therefore from the front of the curtain.

In the modified edge folder 220, a lower shelf member 254 provides a lower shelf 255 having a greater spacing below the folder face plate 252 than the shelf 155 of the edge folder 26. Also, an intermediate flat sheet metal shelf member 280 is mounted in spaced relationship between the shelf 255 and the face plate 252. The lower and intermediate shelves 255, 280 are mounted beneath the face plate 252 by rivet-like fasteners 264 and so as to provide upper and lower shelf pockets uninterrupted along their inner edges. Also, the inner fold edges 276, 284 of the shelf members 254, 280 respectively are in parallel vertically spaced relationship and parallel to the direction of movement of the material blanks, and the sheet metal material guide 250 functions in a manner similar to the guide 150 to fold the material edge portion 21 about those parallel vertically spaced fold edges 276, 284 and into the upper shelf pocket provided by the intermediate shelf 280.

The intermediate shelf 280 has a forward narrow cantilever guide 285 with an outer fold edge 286 (in addition to the inner fold edge 284) that extends parallel to the path of movement of the material. The intermediate cantilever guide extends substantially to but short of a front ramp 261 of the shelf member 254. A secondary sheet metal guide 290 mounted between the guide 250 and the lower shelf 255 cooperates with the narrow cantilever guide 285 of the intermediate shelf 280to fold the material edge downwardly and inwardly about the fold edge 286 and between the intermediate shelf 280 and lower shelf 255 to form the tucked edge 224. For that purpose, the secondary sheet metal guide 290 is formed with a longitudinally extending forwardly inwardly and downwardly inclined guide edge 292 for guiding the edge of the material downwardly and inwardly about the longitudinally extending fold edge 286 of the cantilever guide 285. The double folded inner edge of the hem 222 is then conveyed onto a centilever exit guide 270 of the lower shelf member 254 and thereby onto the table 14. Also, as with the folder 26, the underlying conveyor belts 42–44 serve to convey the underlying material edge portion 21 along and through the edge folder 220 and upwardly onto the table 14 into engagement with the overlying conveyor belts 41.

As will be apparent to persons skilled in the art, various modifications, adaptations and variations of the foregoing specific disclosure can be made without departing from the teachings of the present invention.

We claim:

1. In a sewing machine system having material conveyance means for individually conveying continuously without interruption material blanks longitudinally forwardly in succession along an elongated material path through successive material folding and sewing stations, and material folding and sewing apparatus at the material folding and sewing stations for respectively prefolding each material blank and sewing the prefolded material blank as it is conveyed longitudinally forwardly through said stations continuously without interruption, the improvement wherein the material folding apparatus comprises first and second successive material folding means at the folding station for sequentially folding a longitudinally extending portion of each material blank to a first intermediate longitudinally extending folded condition and then from its intermediate folded condition to a predetermined prefolded condition respectively as the material blank is conveyed by the material conveyance means therethrough continuously without interruption, the first material folding means being operable for folding the entire said longitudinally extending portion of the material blank to said intermediate folded condition substantially simultaneously and automatically in coordination with the conveyance of the material blank continuously without interruption along the material path through the folding station by the material conveyance means, the first material folding means comprising a retractable material support retractable from a first normal position for supporting a predetermined part of each material blank as it is being conveyoed along the generally longitudinally horizontally extending material path on the table to a retracted position freeing said material part to fold downwardly to provide said intermediate folded condition of the material blank, and retracting means for automatically retracting the retractable material support in coordination with the conveyance of each material blank continuously without interruption along the elongated material path by the material conveyance means and so that said material support is retracted when said material part overlies the retractable support.

2. A sewing machine system according to claim 1 wherein the said longitudinally extending portion of the material blank is a longitudinally extending edge portion, and wherein the first material folding means is operable for folding said longitudinally extending edge portion to said intermediate folded condition along its full length at one time while the material blank is being conveyed by the material conveyance means continuously without interruption.

3. A sewing machine system according to claim 2 wherein the first material folding means comprises pneumatic means for pneumatically urging said longitudinally extending edge portion to its said intermediate folded condition.

4. A sewing machine system according to claim 1 wherein the elongated material path is a horizontally forwardly extending material path and wherein the first material folding means is operable for folding said longitudinally extending portion of the material blank downwardly along its full longitudinal length.

5. A sewing machine system according to claim 2 wherein the second material folding means comprises edge folder means operable for folding the longitudinally extending edge portion of the material blank from its said intermediate folded condition to a said predetermined folded condition having a front hem face, a back hem face underlying the front hem face and a tucked edge intermediate the back and front hem faces.

6. A sewing machine system according to claim 5 wherein the elongated material path is a generally horizontally longitudinally extending material path, and wherein the edge folder means comprises a generally flat longitudinally horizontally extending face plate for supporting said front hem face and having a longitudinally extending outer fold edge, a shelf member having a generally longitudinally horizontally extending shelf underlying the face plate providing an intermediate pocket therebetween and an exit guide extending longitudinally forwardly from the shelf, the shelf member having a longitudinally extending inner fold edge laterally inwardly of the outer fold edge of the face plate and extending along the inner edge of the shelf and exit guide, and guide means for guiding said material edge portion inwardly below the face plate to form said underlying back hem face and upwardly and outwardly about the inner fold edge of the shelf member into said pocket between the face plate and shelf to form the tucked edge, the exit guide being operable for guiding the tucked edge into engagement with and between said front and back hem faces as the material blank is conveyed forwardly through the edge folder means.

7. A sewing machine system according to claim 6 wherein the material conveyance means comprises belt conveyor means extending longitudinally forwardly beneath the face plate and engageable with said material edge portion for assisting in longitudinally forwardly conveying the material blank through the edge folder means continuously without interruption.

8. In a sewing machine system having a support table for supporting material blanks for being individually longitudinally forwardly conveyed along a generally longitudinally horizontally extending material path thereon, material conveyance means for individually conveying continuously without interruption material blanks longitudinally forwardly in succession along the material path through successive material folding and sewing stations, and material folded and sewing apparatus at the folding and sewing stations respectively for sequentially folding a portion of each material blank into a predetermined prefolded condition and sewing the material blank in its prefolded condition as the material blank is conveyed longitudinally forwardly continuously without interruption through the folding and sewing stations by the material conveyance means, the improvement wherein the material folding apparatus comprises first and second successive material folding means along the generally longitudinally horizontally extending material path for sequentially folding said portion of each material blank to a first intermediate folded condition and then from its intermediate folded condition to said predetermined prefolded condition respectively, the first material folding means comprising a retractable material support retractable from a first normal position for supporting a predetermined part of each material blank as it is being conveyed along the generally longitudinally horizontally extending material path on the table to a retracted position freeing said material part to fold downwardly to provide said intermediate folded condition of the material blank, and retracting means for automatically retracting the retractable material support in coordination with the conveyance of each material blank continuously without interruption along the elongated material path by the material conveyance means and so that said material support is retracted when said material part overlies the retractable support.

9. A sewing machine system according to claim 8 wherein the first folding means further comprises means for deflecting said material part downwardly when said material support is retracted.

10. A sewing machine system according to claim 8 wherein the retractable material support provides for supporting a longitudinally extending edge part of each material blank.

11. A sewing machine system according to claim 10 wherein the support table has a generally longitudinally horizontally extending fold edge laterally inwardly of the retractable material support for folding said edge part of the material blank downwardly thereabout when said material support is retracted.

12. A method of prefolding and sewing a hem along an elongated edge of a material blank having a front hem face and a back hem portion comprising the steps of longitudinally forwardly conveying continuously without interruption a material blank along a generally horizontally longitudinally extending material path with the material blank positioned with its said elongated edge extending generally parallel to the material path, initially folding a material edge section extending longitudinally along the entire length of said elongated edge of the material blank downwardly to depend from a generally horizontally longitudinally extending fold line by substantially simultaneously folding the entire material edge section downwardly at one time as the material blank is being conveyed continuously without interruption along the material path, and then progressively folding the depending material edge section into said back hem portion to prefold said hem along the elongated edge of the material blank as the material blank is being longitudinally forwardly conveyed along the material path continuously without interruption and then progressively sewing the prefolded hem as the prefolded material blank is being longitudinally forwardly conveyed along the material path continuously without interruption.

13. An elongated edge folding device for use in a sewing machine installation for prefolding a longitudinally extending edge portion of a material blank as the material blank is conveyed longitudinally forwardly through the edge folding device, comprising a longitudinally extending face plate for supporting a longitudinally extending section of the material blank laterally inwardly of said edge portion as the material blank is conveyed longitudinally forwardly through the edge folding device and having an outer longitudinally extending fold edge for said longitudinally extending material edge portion, a lower shelf member underlying the face plate defining a longitudinally extending pocket therebetween, the shelf member having a longitudinally extending inner fold edge laterally inwardly of said outer fold edge and said pocket, an intermediate longitudinally extending shelf member intermediate said lower shelf member and face plate and dividing said pocket into upper and lower pocket portions thereof, the intermediate shelf member having a longitudinally extending outer folder edge laterally intermediate said outer fold edge of the face plate and the inner fold edge of the lower shelf member; material fold means for folding the material edge portion downwardly and laterally inwardly for folding said material edge portion about said outer fold edge of the face plate and then upwardly and laterally outwardly for folding said material edge portion about said inner fold edge and into the upper pocket portion and then downwardly and laterally inwardly around said intermediate fold edge and into the lower pocket portion, all as the material blank is conveyed longitudinally forwardly through the edge folding device; the material fold means comprising first guide edge means extending from a rearward point longitudinally rearwardly of and laterally inwardly of said inner fold edge longitudinally forwardly into said upper pocket portion between the intermediate shelf member and face plate for progressively folding the material edge portion around said inner fold edge and into said upper pocket portion as the material blank is conveyed longitudinally forwardly through the edge folding device, and second guide edge means extending longitudinally from the upper pocket portion laterally outwardly around said intermediate fold edge and laterally inwardly into the lower pocket portion for progressively folding the material edge portion around the intermediate fold edge of the intermediate shelf member and into the lower pocket portion as the material blank is conveyed longitudinally forwardly through the edge folding device.

14. An elongated edge folding device according to claim 13 wherein the guide plate has a rear entrance end sloping longitudinally forwardly upwardly to said rearward point of the first guide edge means.

* * * * *